US005492038A

United States Patent [19]

Chylinski et al.

[11] Patent Number: 5,492,038

[45] Date of Patent: Feb. 20, 1996

[54] SHAVING SYSTEM

[75] Inventors: Henryk J. Chylinski, Haverhill; Chester F. Jacobson, Southboro; Timothy M. Salisbury, Pembroke; Frederick R. Borden, Brockton, all of Mass.

[73] Assignee: The Gillette Company, Boston, Mass.

[21] Appl. No.: 399,624

[22] Filed: Mar. 7, 1995

Related U.S. Application Data

[62] Division of Ser. No. 245,245, May 17, 1994.

[51] Int. Cl.[6] ..... B21K 5/12; B24B 3/00

[52] U.S. Cl. ..... 76/116; 451/45; 451/48

[58] Field of Search ..... 76/115, 116, DIG. 8; 30/49; 451/45, 48, 65, 293, 285, 229, 248

[56] References Cited

U.S. PATENT DOCUMENTS

| | | |
|---|---|---|
| 1,672,516 | 6/1928 | Drew . |
| 2,359,584 | 10/1944 | Roehnes . |
| 2,598,711 | 6/1952 | Musso . |
| 2,614,321 | 10/1952 | Ackerman . |
| 2,632,242 | 3/1953 | Musso . |
| 3,216,286 | 11/1965 | Heyek . |
| 3,465,436 | 9/1969 | Musso . |
| 3,522,678 | 8/1970 | Scholin . |
| 3,631,641 | 1/1972 | Scholin . |
| 3,702,026 | 11/1972 | Scholin . |
| 3,786,563 | 1/1974 | Dorion, Jr. et al. . |
| 4,483,068 | 11/1984 | Clifford . |
| 4,807,360 | 2/1989 | Levier et al. . |
| 4,875,288 | 10/1989 | Trotta et al. . |
| 4,964,214 | 10/1990 | Welsh et al. . |
| 4,979,298 | 12/1990 | Pesirs . |
| 4,984,365 | 1/1991 | Leonard et al. . |
| 5,031,317 | 7/1991 | Jacobson . |
| 5,088,195 | 2/1992 | Lazarshik et al. . |

FOREIGN PATENT DOCUMENTS

| | | |
|---|---|---|
| 598803 | 10/1959 | Italy . |
| WO88/04980 | 7/1988 | WIPO . |

*Primary Examiner*—Hwei-Siu Payer
*Attorney, Agent, or Firm*—Fish & Richardson

[57] ABSTRACT

A shaving system of the wet shave type includes support structure and blade structure secured to the support structure. The blade structure has an aperture with an annular sharpened shaving edge that is defined by main facet portions that converge at an angle of less than 40°, and supplemental facet portions that are extensions of the main facet portions and converge at an included angle of less than 60° to define an annular ultimate tip portion. The annular ultimate tip of the sharpened edge defines a shaving plane and the bisector of the included angle defined by the supplemental facets is disposed at an angle (shaving angle) in the range of 15°–35° to the shaving plane.

8 Claims, 2 Drawing Sheets

SHAVING SYSTEM

This is a divisional of application Ser. No. 08/245,245, filed May 17, 1994.

This invention relates to shaving systems of the wet shave type, and more particularly to shaving systems that employ blade structures with annular cutting edge structures.

A number of shaving systems with blade structures that have annular cutting edge structure have been proposed, see for example, Ackerman U.S. Pat. No. 2,614,321; Musso U.S. Pat. No. 3,465,436; Scholin U.S. Pat. No. 3,702,026; Cerier U.S. Pat. No. 4,807,360; Trotta U.S. Pat. No. 4,875,288; and Welsh U.S. Pat. No. 4,964,214. In general, shaving characteristics of such shaving systems have not been entirely satisfactory.

In accordance with one aspect of the invention, there is provided a shaving system of the wet shave type that includes support structure and blade structure secured to the support structure. The blade structure has an aperture that defines an annular sharpened shaving edge that is defined by main facet portions that converge at an angle of less than 40°, and supplemental facet portions that are extensions of the main facet portions and converge at an included angle greater than the main facet angle but less than 60° to define an annular ultimate tip portion. The annular ultimate tip defines a shaving plane and the bisector of the included angle defined by the supplemental facets is disposed at an angle (shaving angle) in the range of 15°–35° to the shaving plane.

The blade structure may take a variety of forms and the aperture may be of circular, elongated or other shape. In preferred embodiments, the aperture has a width dimension (the distance between opposed sharpened edges of the same aperture) of less than one centimeter; the radial length dimension of the main facet portions is at least about twice the radial length of the contiguous supplemental facet portions; and each supplemental facet portion has a radial length of less than about 0.3 millimeter.

In a particular embodiment, the structure is a metal blade member that has a generally tubular upstanding body portion of predetermined height that defines a central aperture, and an integral, inwardly facing flange is provided at its upper end on which the annular sharpened shaving edge is formed. In that embodiment, the shaving angle (the angle between the shaving plane and the bisector of the sharpened edge) is in the range of 20°–32°, the ultimate tip is defined by supplemental facets that have an included angle in the range of 25°–40°, and the ultimate tip has a radius of less than 1,000 angstroms. The support structure has at least ten apertures in which corresponding blade members are disposed, and the support structure includes biasing structure that permits the individual blade members to move relative to the support structure independently of one another between spaced limiting structure on the support structure which cooperates with stop structure integral with the blade members.

In accordance with another aspect, there is provided a method of manufacturing a razor blade comprising the steps of providing a blade member with an annular body portion and an annular flange portion at one end of the annular body portion that extends radially inward from the body portion, disposing the blade member on a cylindrical mandrel of abrasive material that has an inclined facet at its upper end such that the inner surface of the inwardly facing flange portion is juxtaposed with and supported by the inclined facet, providing abrasive structure adjacent the outer surface of the mandrel flange portion, and producing relative motion between the abrasive structure and the blade member to rotate the blade member on the mandrel while an inner surface of the flange portion is in engagement with the mandrel facet and an outer surface of the flange portion is in engagement with the abrasive structure to abrasively shape and form facets on inner and outer surfaces of the flange portion to provide an annular shaving edge on said blade member.

Preferably, the annular shaving edge has a width dimension of less than one centimeter, and the abrasive structure is driven in rotation at a speed of at least 600 RPM. In one embodiment, the rotational axis of the abrasive structure is generally perpendicular to the mandrel axis and in another embodiment these axes are generally parallel.

Other features and advantages of the invention will be seen as the following description of particular embodiments progresses, in conjunction with the drawings, in which.

DESCRIPTION OF PARTICULAR EMBODIMENTS

Figure 1:
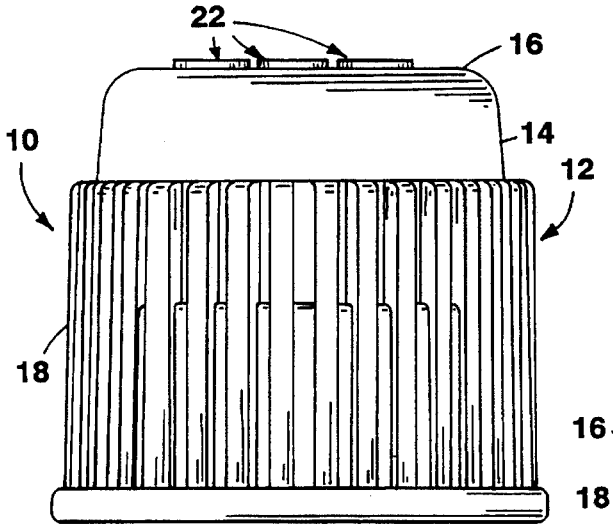
FIG. 1 is a side elevational view of a shaving system in accordance with the invention.
Figure 2:
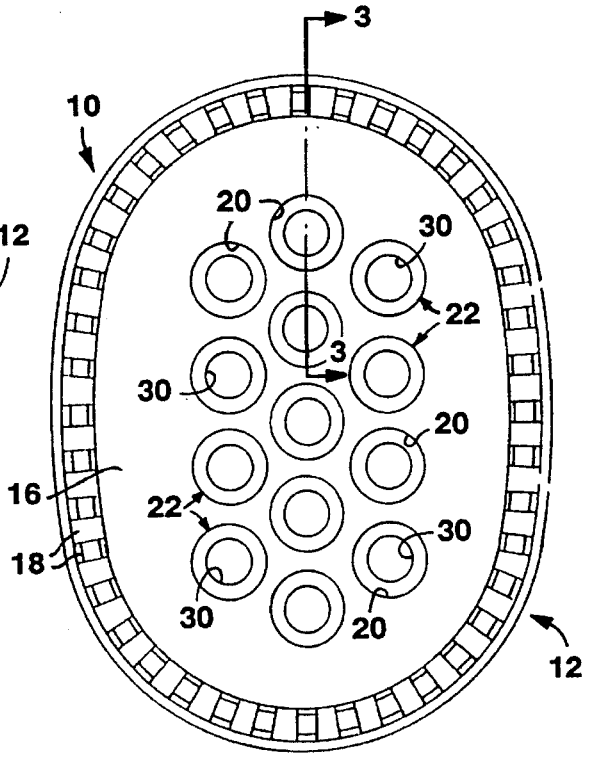
FIG. 2 is a top plan view of the shaving system of FIG. 1.
Figure 3:
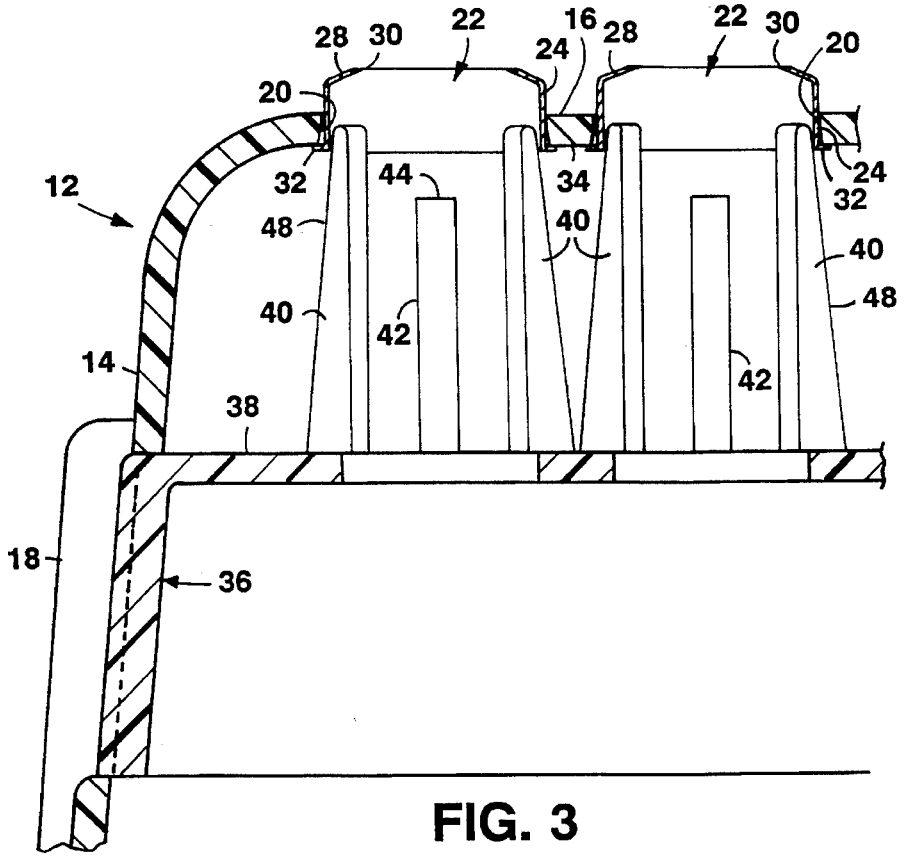
FIG. 3 is an enlarged sectional view of a portion of the shaving system shown in FIGS. 1 and 2 taken along the line 3—3 of FIG. 2.

The shaving system 10 shown in FIGS. 1 and 2 is of the type shown in Jacobson U.S. Pat. No. 5,031,317, the disclosure of which is expressly incorporated herein by reference, and includes polypropylene housing 12 with side wall 14 and top wall 16. Side wall 14 is provided with elongated ribs 18 on its exterior surface with serve as grasping structure for the shaving system. The top wall 14 is provided with an array of apertures 20 which receive tubular blade units 22. Each blade unit 22, as indicated in FIG. 3, has a generally tubular wall 24 defining a central aperture therethrough. An integrally formed flange 28 extends inwardly from the upper end of tubular wall 24 and has an annular, inwardly directed, cutting edge 30 at a free end thereof. A second integrally formed flange 32 extends outwardly from the lower end of the tubular wall and is adapted to be disposed against an under surface 34 of top wall 16 of housing 12. The blade units 22 are preferably of metal, such as treated steel.

With reference to FIG. 3, there will be seen that the shaving system includes a nylon base member 36 attached to and contained within housing 12. The undersurface 34 of housing 12 and the upper surface 38 of base member 36 are disposed generally parallel to and spaced from each other. Resilient spring fingers 40 extend upwardly from the upper surface 38 of base member 36 and extend into the blade units 22 and bias the lower flanges 32 upwardly against the inner surface 34 of housing top wall 16. Rigid protrusions 42 extend from the upper surface 38 of base member 36 with the spring fingers 40 and the protrusions 42 are arranged in general alignment with the housing apertures 20. Each razor blade unit 22 is disposed in a corresponding aperture 20 in the housing top wall with three spring fingers 40 extending into the lower end of each tubular blade unit 22. The rigid protrusions 42 are provided with flat surfaces 44 at their free upper ends that are adapted to limit the downward movement of the blade units 22 and spring fingers 40 have inclined outboard surfaces.

In a particular embodiment, each blade unit 22 is of 0.1 millimeter thickness steel and has a cylindrical body portion 24 of about 6.7 millimeters outer diameter and about 2.5 millimeters height; upper flange 28 that is inclined upwardly at an angle of 30° with cutting edge 30 defining a circle of about five millimeters diameter; and horizontal lower flange 32 that has an outer edge of about 7.5 millimeters diameter.

Figure 4:
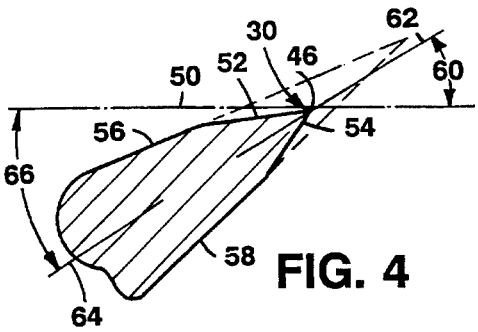
FIG. 4 is an enlarged diagrammatic view of a portion of the blade edge of a blade unit employed in the shaving system shown in FIGS. 1–3.

A further enlarged view of the portion of cutting edge 30 is shown in FIG. 4. As shown in that figure, the ultimate tip 46 of each sharpened shaving edge 30 has a radius of about 600 angstroms and defines shaving plane 50 and edge 30 and tip 46 are defined by supplemental facet surfaces 52, 54 that are disposed at an angle of about 28° to each other, surface 52 being disposed at an angle of about 10° to shaving plane 50 and surface 54 being disposed at an angle of about 38° to plane 50. Adjacent to and contiguous with upper supplemental facet 52 is upper main facet 56 that is disposed at an angle of about 14° to shaving plane 50 and adjacent to and contiguous with lower supplemental facet 54 is lower main facet 58 disposed at an angle of about 33° to shaving plane 50. The shaving angle 60 (the angle between the bisector 62 of the facets 52, 54 that define the ultimate tip 46 and shaving plane 50) is about 24°, and the bisector 64 of the main facets 56, 58 is disposed at an angle 66 of about 23.5° to shaving plane 50.

Figure 5:
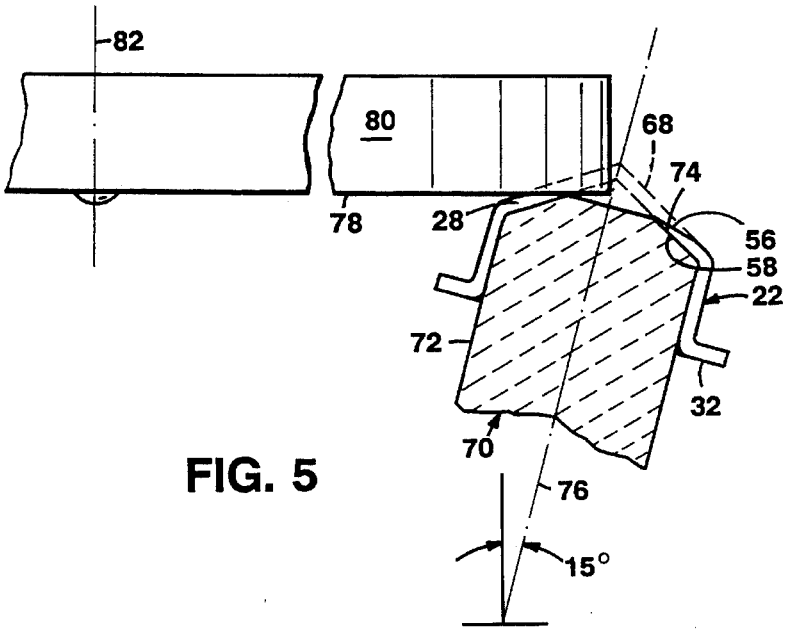
FIG. 5 is a diagrammatic view of apparatus for forming main facets on the blade unit of FIG. 4.

Blade unit 22 is sharpened in a two stage sharpening operation. With reference to FIG. 5, an unsharpened blade unit 22 with 30° conical upper portion 68 is placed on a sapphire mandrel 70 that has a cylindrical body 72 of about six millimeters diameter and a 30° facet 74 at its upper end. Axis 76 of mandrel 70 is disposed at an angle of 15° to the face 78 of aluminum oxide abrasive wheel 80 of about fifteen centimeters diameter. Wheel 80 is rotated at 1700 RPM about axis 82. The rotation of wheel 80 with its surface 78 in pressing engagement with upper flange 28 abrades conical portion 68 and causes blade unit 22 to spin on sapphire mandrel 70 and the wheel pressure forcing flange 28 down in flexing action against mandrel facet 74 as blade unit 22 is spinning to form lower grind (main) facet 58. Simultaneously, wheel surface 78 interacts with the upper surface of flange 28 to form upper grind (main) facet 56. Facet 56 forms an angle of about 14° to shaving plane 50; facet 58 is disposed at an angle of about 33° to plane 50; the included angle between facets 56 and 58 about being 19° and bisector 64 being disposed at about 23.5° to plane 50 (angle 66—FIG. 4).

Figure 6:
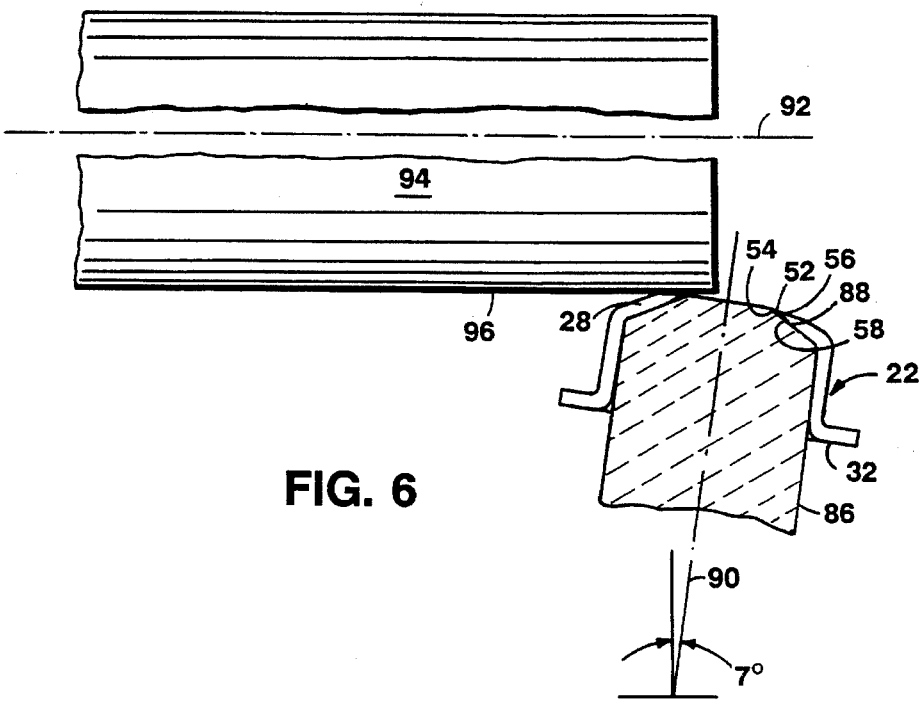
FIG. 6 is a diagrammatic view of apparatus for forming supplemental facets on the blade unit of FIG. 4.

With reference to FIG. 6, the ground blade unit 22 is then placed on a 15 micron grit cubic boride nitride (CBN) finish mandrel 86 of the same diameter as mandrel 70 and with facet 88 at a 33° angle. The axis 90 of finish mandrel 86 is offset 83° to the axis 92 of rotation of Corfam strop finish cylinder 94. Cylinder 94 is about fifteen centimeters in length and about eighteen centimeters diameter and loose one micron aluminum oxide abrasive is applied to its surface. The ground blade unit 22 is passed across the abrasively loaded finish strop 94 as that strop 94 is rotated at 1000 RPM to form supplemental facets 52, 54. The rotation of cylinder 94 with its surface 96 in pressing engagement with upper facet 56 causes blade unit 22 to spin on finish mandrel 86 about axis 90 and the cylinder pressure of cylinder 94 forces facet 58 down in flexing action against mandrel facet 88 as blade unit 22 is spinning to form supplemental facet 54. Simultaneously, cylinder surface 96 interacts with upper facet 56 to form supplemental facet 52. (This finish process step removes blade edge material as diagrammatically indicated by dashed lines in FIG. 4.) Upper supplemental facet 52 has a length of about two micrometers and is disposed at an angle of about 10° to plane 50 and lower supplemental facet 54 has a length of about four micrometers and is disposed at an angle of about 38° to plane 50 (the included angle between facets 52, 54 being about 28° and bisector 62 being disposed at about 24° to plane 50. The angles of supplemental facets 52, 54 are measured at approximately 1.5 micrometers from tip 30 and the main facet angles are measured at about 0.1 millimeter from tip 30. The resulting shaving angle 60 is about 24°.

Coatings of metal and/or polymer may be applied to the sharpened edges as desired, and the processed blade units 22 are assembled in shaving system 10.

In assembly, the blade units 22 are mounted on the spring fingers 40 of the base member 36 (or may be inserted into the apertures 20 of the housing member 12); and the housing member 12 and base member 36 are brought together to secure the blade units 22 therebetween. The housing and base member sidewalls may simply "snap" together and be locked with a detent arrangement. The blade units 22 rest on the inclined outer edges of the spring fingers 40 with the lower flanges 32 of the blade units engaging the undersurface 34 of the housing top wall 16. The configuration and dimensions of the spring fingers 40 are tailored to permit safe and efficient dynamic movement of the blade units 22 such that the blade units retract into the housing 12 when a normal force on the blade units exceeds about five grams. The blade units 22 move reciprocally into the housing 12 and also tilt to accommodate contours of the surface being shaved.

During a shaving operation, the spring fingers 40 provide resilient support for the blade units 22 with their lower flanges 32 retaining the blade units 22 in the apertures 20. The downward movement of the blade units 22 into the housing 12 is limited by engagement of the lower flanges 32 with the flat surfaces 44 of the ridge protrusions 42. When pressure is eased on a blade unit 22, the fingers 40 tend to return to their unstressed state and their inclined edges cause the blade unit 22 to ride upwardly to its more elevated position.

Thus, each blade unit 22 is able to move reciprocally and tiltingly during a shaving operation, responding dynamically to the surface being shaved, the blade units 22 "floating" above the housing top wall 16 so that collectively the blade units conform to the surface being shaved, be it convex or concave. The resulting shaving system exhibits quality shaving characteristics and good shaving life. Further details of the shaving system may be had with reference to Jacobson U.S. Pat. No. 5,031,317, the disclosure of which is expressly incorporated herein by reference.

Figure 7:
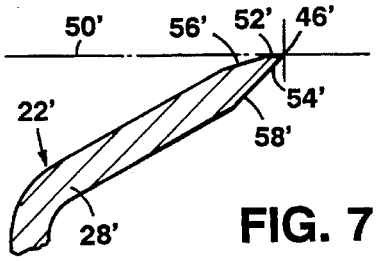
FIG. 7 is an enlarged view (similar to FIG. 4) of a portion of another blade unit in accordance with the invention.

Another blade unit embodiment is illustrated FIG. 7. In that embodiment, the ultimate tip 46' is defined by supplemental facets 52', 54' that have an included angle of 35°; and main facets 56', 58' that have an included angle of about 20°; and the shaving system provides a shaving angle of about 22°. The blade unit 22' of FIG. 7 may be sharpened by any appropriate method, including the method shown and described in connection with FIGS. 5 and 6.

While particular embodiments of the invention have been shown and described, various modifications will be apparent to those skilled in the art, and therefore, it is not intended that the invention be limited to the disclosed embodiment, or to details thereof, and departures may be made therefrom within the spirit and scope of the invention.

What is claimed is:

1. A method of manufacturing a razor blade comprising the steps of providing a blade member with an annular body portion and an annular flange portion at one end of said annular body portion that extends radially inward from said body portion, disposing said blade member on a cylindrical mandrel of abrasive material that has an inclined facet at its upper end such that the inner surface of said inwardly facing flange portion is juxtaposed with and supported by said inclined facet, providing abrasive structure adjacent the outer surface of said flange portion, and producing relative motion between said abrasive structure and said blade member to rotate said blade member on said mandrel while said inner surface of said flange portion is in engagement with said mandrel facet and the outer surface of said flange portion is in engagement with said abrasive structure to abrasively shape and form facets on said inner and outer surfaces of said flange portion to provide an annular shaving edge on said blade member.

2. The method of claim 1 wherein said annular shaving edge has a width dimension of less than one centimeter.

3. The method of claim 2 wherein said mandrel has an axis about which said blade member is rotated, and said abrasive structure is rotated about an axis generally perpendicular to said axis of said mandrel.

4. The method of claim 2 wherein said mandrel has an axis about which said blade member is rotated, and said abrasive structure is rotated about an axis generally parallel to said axis of said mandrel.

5. The method of claim 1 wherein said abrasive structure is mounted for rotation and is driven in rotation at a speed of at least 600 rpm.

6. The method of claim 5 wherein said blade member is a metal blade member that has a generally tubular upstanding body portion of predetermined height that defines a central aperture, and an integral, inwardly facing flange is provided at its upper end on which said annular shaving edge is formed.

7. The method of claim 6 wherein said blade member has a shaving angle is in the range of 15°–32° the ultimate blade tip of said shaving edge is defined by supplemental facets that have an included angle in the range of 20°–40°, and said ultimate tip has a radius of less than 1,000 angstroms.

8. The method of claim 7 wherein said annular shaving edge is of circular configuration and has a diameter of less than one centimeter; said shaving edge is defined by main facet portions that converge at an angle of less than 40°, said supplemental facets are extensions of and contiguous with said main facet portions and converge at an included angle greater than said main facet portions and less than 60° to define said ultimate tip that is disposed within a boundary region defined by imaginary line extensions of said main facet portions; the radial length dimension of each said main facet portion is at least about twice the radial length of its contiguous supplemental facet; and each said supplemental facet has a radial length of less than about 0.3 millimeter.

* * * * *

UNITED STATES PATENT AND TRADEMARK OFFICE
CERTIFICATE OF CORRECTION

PATENT NO. : 5,492,038

DATED : February 20, 1996

INVENTOR(S) : Henryk J. Chylinski et al.

It is certified that error appears in the above-identified patent and that said Letters Patent is hereby corrected as shown below: On the title page: Item

[56] References Cited" section:
"Roehnes" should be --Roehner--;
"Pesirs" should be --Pesiri--.

Signed and Sealed this

Twentieth Day of August, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,492,038

DATED : February 20, 1996

INVENTOR(S) : Henryk J. Chylinski et al.

It is certified that error appears in the above-identified patent and that said Letters Patent is hereby corrected as shown below:

Col. 3, line 7, after "surfaces" insert --48--.

Col. 4, line 27, after "edges" insert --48--.
line 44, after "edges" insert --48--.

Signed and Sealed this

Fifth Day of November, 1996

Bruce Lehman

*Attest:*

BRUCE LEHMAN

*Attesting Officer*

*Commissioner of Patents and Trademarks*